United States Patent [19]

Harandi

[11] Patent Number: 4,606,816

[45] Date of Patent: Aug. 19, 1986

[54] METHOD AND APPARATUS FOR MULTI-COMPONENT FRACTIONATION

[75] Inventor: Mohsen N. Harandi, Sewell, N.J.

[73] Assignee: Mobil Oil Corporation, New York, N.Y.

[21] Appl. No.: 687,790

[22] Filed: Dec. 31, 1984

[51] Int. Cl.[4] ..... C10G 7/00

[52] U.S. Cl. ..... 208/354; 203/DIG. 19; 208/355; 208/352; 208/356; 208/358; 208/363

[58] Field of Search ..... 208/354, 355, 350, 352, 208/356, 358, 363; 203/DIG. 19

[56] References Cited

U.S. PATENT DOCUMENTS

| | | | |
|---|---|---|---|
| 2,844,518 | 7/1958 | Blanding et al. | 196/50 |
| 2,920,039 | 1/1960 | Miller | 208/361 |
| 3,173,859 | 3/1965 | Chambers | 208/354 |
| 3,210,271 | 10/1965 | Byerly et al. | 208/356 |
| 3,303,127 | 2/1967 | Potts et al. | 208/363 |
| 3,320,159 | 5/1967 | Potts | 208/354 |
| 3,494,861 | 2/1970 | Munro | 208/356 |
| 3,585,124 | 6/1971 | Myers | 208/354 |
| 4,033,857 | 7/1977 | Williams et al. | 208/102 |
| 4,239,618 | 12/1980 | Peiser et al. | 208/355 |
| 4,415,443 | 11/1983 | Murphy | 208/355 |

FOREIGN PATENT DOCUMENTS

| | | | |
|---|---|---|---|
| 2413463 | 10/1975 | Fed. Rep. of Germany | 208/354 |
| 1020667 | 2/1966 | United Kingdom . | |

*Primary Examiner*—John Doll
*Assistant Examiner*—A. Pal
*Attorney, Agent, or Firm*—Alexander J. McKillop; Michael G. Gilman; Dennis P. Santini

[57] ABSTRACT

Fractionation method and apparatus are provided, wherein heavy product is withdrawn from a first fractionator and introduced into a second fractionator, which operates in a predetermined moderate pressure range. The withdrawn heavy product is separated into relatively light ends and relatively heavy ends by introducing stripping vapor into a lower section of the second fractionator. A controlled stream of light product quench, including bottoms product from the stripper, is introduced at a predetermined low temperature and a predetermined variable flow rate to the second fractionator to adjust an end point of overhead products exiting therefrom. Second fractionator overhead product is passed into the stripper, and light components from the first fractionator are introduced into the stripper, such that overhead products from the second fractionator strip light ends from the relatively light product components from the first fractionator. Stripper overhead is separated into light and heavy ends by introducing it into the first fractionator, such that these overhead products are further fractionated in the first fractionator.

40 Claims, 6 Drawing Figures

METHOD AND APPARATUS FOR MULTI-COMPONENT FRACTIONATION

BACKGROUND OF THE INVENTION

1. Field of the Invention

This invention relates to apparatus and method for fractionation, for example, for recovering gasoline and light cycle oil from bottoms product of a main column associated with a fluid catalytic cracking system.

2. Description of the Prior Art

In fluid catalytic cracking operations, because gasoline and light cycle oil (LCO) are economically more valuable than main column bottoms (MCB) product, it is desirable to recover light ends from MCB product. The light ends content of MCB product depends on the operating conditions of the fluid catalytic cracking (FCC) main column fractionator unit, and particularly, on the flash zone temperature which is limited to a maximum value because of increased coking tendency of heavy hydrocarbons at elevated temperatures. The maximum flash zone temperature requirement limits the separation obtainable between LCO and MCB product. Typically, approximately 10% of the MCB product comprises LCO and lighter components.

FIG. 1 illustrates a conventional system using a single side stripper 67 associated with main column fractionator 115. MCB product is withdrawn along line 101 as residuals product. Side draw 123 from main column 115 is passed to stripper 67, with overhead product from stripper 67 being recycled to main column 115. Stripping steam is introduced via line 127 into stripper 67 and LCO is withdrawn from stripper 67 along line 119. Also, receiver/separator 117 receives main column 115 overhead, after partial condensing, to provide recovered products via lines 49 and 53. This system is disadvantageous in that the MCB product contains a significant quantity of light components.

SUMMARY OF THE INVENTION

It is an object of the present invention to provide a system for integrating plural side strippers of a fractionator which lessens the main fractionator loadings and for reducing stripping steam usage.

It is a further object to provide a fractionation method and apparatus wherein a fractionator has two product draws, one heavier, the other lighter, the lighter product being stripped in a light product stripper, and wherein it is desirable to recover lighter products from the relatively heavy product draw, with a second fractionator receiving the relatively heavy product, stripping the relatively lighter components from the relatively heavier ones therein, and rectifying the vapor stream exiting the second fractionator with a quench stream from the light product stripper, such that overall economy of the system is improved.

It is also an object to provide a method and apparatus for recovery of gasoline and light cycle oil from the main column bottoms product of a fluid catalytic conversion system.

It is another object to provide such method and apparatus wherein steam is utilized as the only medium for separating light components from main column bottoms product.

It is yet another object to provide such method and apparatus wherein the overhead vapor of a main column bottoms/light cycle oil fractionator is used as the stripping medium for a light cycle oil stripper.

It is still another object to provide such method and apparatus wherein the light cycle oil stripper and main column system are used to fractionate the light ends recovered in the main column bottoms/light cycle oil fractionator, and further without significantly affecting the equipment loadings and normal operations of the various units.

Another object is to provide such method and apparatus wherein the end point of the light ends separated from main column bottoms product is controlled by adjusting a flow and temperature of light cycle oil quench passed to an upper section of the main column bottoms/light cycle oil fractionator.

According to the present invention, a fractionation method is provided which comprises the steps of (a) withdrawing a first relatively heavy product and a second relatively light product from a first fractionator; (b) introducing the second relatively light product into a light product stripping zone; (c) introducing the first relatively heavy product into a stripping zone of a second fractionator, this latter stripping zone for stripping relatively lighter components from relatively heavier components of the first relatively heavy product, the second fractionator operating in a predetermined moderate pressure range sufficient to provide integration of the second fractionator with the the first fractionator and the light product stripping zone; and (d) introducing a quench stream comprising relatively light stripped product from the light product stripping zone into a rectifying zone of the second fractionator to control an end point of the overhead product exiting the second fractionator. The overhead product exiting the second fractionator can be introduced into the light product stripping zone or, alternatively, can be introduced into the first fractionator. The first relatively heavy product can be a bottoms product draw of the first fractionator or alternatively, can be a side draw of the first fractionator.

An an alternative to step (c) above, the first relatively heavy product can be introduced into a flash drum operating in a predetermined moderate pressure range sufficient to provide integration of the flash drum with the first fractionator, and the overhead product exiting the flash drum can be introduced into the first fractionator for further fractionation of this overhead product. The overhead product from the flash drum can be introduced into the first fractionator at a point above a quench nozzle of the first fractionator.

Also according to the present invention, a fractionation method is provided, which includes the steps of withdrawing bottoms product from a first fractionator and introducing the withdrawn bottoms product into a second fractionator, operating in a predetermined moderate pressure range sufficient to provide integration of the second fractionator with the first fractionator and to allow transfer of overhead product from the second fractionator into a stripper zone and thereafter into the first fractionator. The method also includes separating the withdrawn bottoms product into relatively light ends and relatively heavy ends by introducing stripping vapor into a lower section of the second fractionator, and introducing a controlled stream of light cycle oil quench comprising bottoms product from the stripper zone at a predetermined low temperature and flow rate into an upper section of the second fractionator to adjust an end point of overhead products exiting the second fractionator. The method further includes passing the overhead products exiting the second fractionator into a lower section of the stripper and introducing cycle oil from an intermediate section of the first fractionator into an upper section of the stripper zone, with the overhead products from the second fractionator stripping light ends from the cycle oil. Additionally, the method includes separating overhead product from the stripper zone into relatively light ends and relatively heavy ends by introducing the overhead product from the stripper zone into an upper section of the first fractionator, such that the overhead products from the stripper zone are further fractionated in the first fractionator.

The first fractionator can be a main column fractionator of a fluid catalytic conversion system. The stripper zone can comprise a light cycle oil stripper, and the second fractionator can comprise a main column bottoms/light cycle oil fractionator. The aforementioned stripping vapor and the bottoms product from the main column fractionator can be mixed prior to being introduced into the main column bottoms/light cycle oil fractionator. The controlled stream of light cycle oil quench can be passed through a cooler prior to being introduced into the upper section of the main column bottoms/light cycle oil fractionator. The aforementioned stripping vapor can comprise steam. The overhead product from the main column bottoms/light cycle oil fractionator, which is introduced into the lower section of the light cycle oil stripper, can constitute the only stripping vapor for the cycle oil introduced into the upper section of the light cycle oil stripper. The light cycle oil stripper and main column fractionator can fractionate light ends overhead product introduced from the main column bottoms/light cycle oil fractionator into the lower section of the light cycle oil stripper. The controlled stream of light cycle oil quench can be introduced into the top tray in the upper section of the main column bottoms/light cycle oil fractionator to control and ASTM End Point of light ends separated from the main column bottoms product introduced into the main column bottoms/light cycle oil fractionator. The light cycle oil quench can be taken directly from the light cycle oil stripper bottoms or, alternatively, the light cycle oil bottoms product can be cooled and the light cycle oil quench can be taken after such cooling. The main column bottoms/light cycle oil fractionator can operate in a pressure range of approximately 40–50 psi. The method of the present invention can further include introducing overhead product from the first fractionator into a gas-liquid separator and recovering unstabilized gasoline from this separator.

Also according to the present invention, a fractionation apparatus is provided which comprises (a) a first fractionator having a first relatively heavy product draw and a second relatively light product draw; (b) a light product stripper receiving relatively light product from said second relatively light product draw; and (c) a second fractionator operating in a predetermined moderate pressure range sufficient to provide integration of the second fractionator with the first fractionator and the light product stripping zone, the second fractionator receiving the relatively heavy product from the relatively heavy product draw and having a stripping zone for stripping relatively lighter components from relatively heavier components introduced therein from the first relatively heavy product draw, and a rectifying zone receiving a quench stream comprising relatively light stripped product from the light product stripper to control an end point of an overhead vapor stream exiting the second fractionator. The overhead vapor stream exiting the second fractionator can be introduced into the light product stripper or, alternatively, into the first fractionator. The relatively heavy product draw can be a bottoms product draw or, alternatively, a side product draw.

As an alternative to the second fractionator, a flash drum can be provided, which is operated in a predetermined moderate pressure range sufficient to provide integration of the second fractionator with the first fractionator, and further including means for introducing overhead product exiting the flash drum into the first fractionator for further fractionation of the overhead product. The overhead product from the flash drum can be introduced into the first fractionator at a point above a quench nozzle of the first fractionator.

Also according to the present invention, a fractionation apparatus is provided, which includes a first fractionator having a bottoms outlet at a bottoms section thereof for removal of bottoms product, an intermediate inlet at an intermediate section thereof, and a cycle oil outlet below the intermediate inlet. The apparatus also includes a stripper having a bottoms outlet, an inlet at a lower section thereof, an inlet at an upper section thereof connected to the cycle oil outlet of the first fractionator, and an overhead outlet connected to the intermediate inlet of the first fractionator. A second fractionator is provided, which operates in a predetermined moderate pressure range sufficient to provide integration of the second fractionator with the first fractionator, and to allow transfer of overhead product from the second fractionator into the stripper and thereafter into the first fractionator. The second fractionator has a bottoms product inlet connected to the bottoms outlet of the first fractionator, means for admitting stripping vapor into the second fractionator below the bottoms product inlet thereof, and an overhead product outlet connected to the inlet at the lower section of the stripper. The apparatus further includes means for introducing a controlled stream of bottoms product from the bottoms outlet of the stripper into an upper section of the second fractionator, with the aforementioned stream having a predetermined low temperature and flow rate to control an end point of overhead products exiting the overhead products outlet of the second fractionator, whereby bottoms product from the first fractionator flashes in the second fractionator from contact with stripping vapor introduced therein, light ends from the second fractionator pass into the stripper to strip light ends introduced into the stripper from the first fractionator and light ends from the stripper pass into the first fractionator for further fractionation.

Also according to the present invention, a fractionation method is provided in a fractionation system, which includes a first fractionator, stripper means, and a second fractionator. An improvement is provided comprising (a) operating the second fractionator in a predetermined moderate pressure range sufficient to provide integration of the second fractionator with the first fractionator, and to allow transfer of overhead product from the second fractionator into the stripper and thereafter into the first fractionator; (b) introducing a controlled stream of bottoms product from the bottoms outlet of the stripper into an upper section of the second fractionator, with the stream having a predetermined low temperature and flow rate to control an end point of overhead products exiting the overhead products outlet of the second fractionator; (c) flash separating relatively heavy ends from relatively light ends of the bottoms product from the first fractionator in the second fractionator from contact with stripping vapor introduced therein; (d) passing light ends from the second fractionator into the stripper means to strip relatively light ends introduced into the stripper means from the first fractionator and to recover relatively heavier ends from said stripper means; and (e) passing light ends from the stripper means into the first fractionator for further fractionation.

BRIEF DESCRIPTION OF THE DRAWINGS

The above and other objects, advantages and features of the present invention will be more fully understood when considered in conjunction with the following figures, of which.

DETAILED DESCRIPTION OF THE INVENTION

Figure 2:
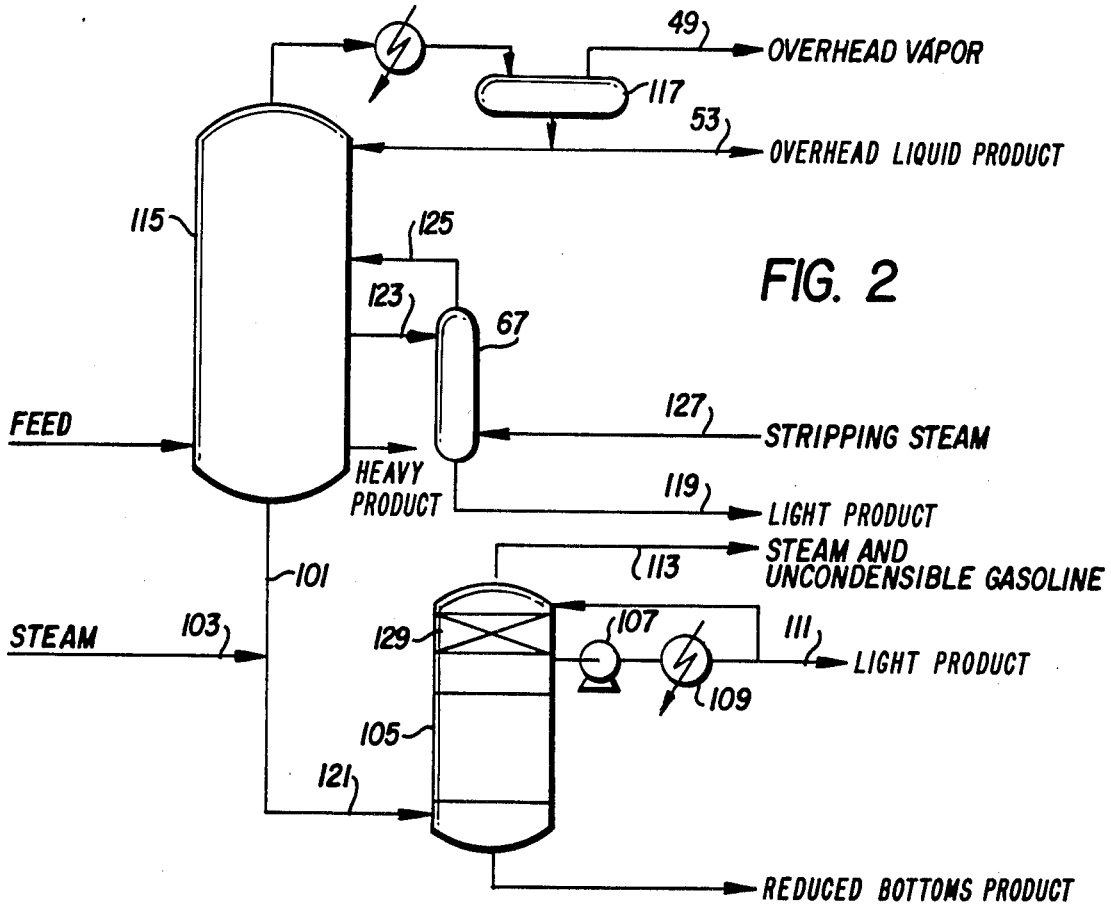
FIG. 2 illustrates a system having plural unintegrated side strippers.

FIG. 2 illustrates a light cycle oil recovery system which uses a low pressure flash-down design, including main column fractionator 115, flash-down tower 105, stripper 67 and receiver/separator 117 receiving main column overhead product, wherein the MCB product stream in line 101 is mixed with steam injected via line 103 before flashing in the bottom of a flashdown tower 105. The vapor phase is rectified by the reflux created by a LCO pumparound, including pump 107 and cooler 109. A LCO side draw 111 from the pumparound is used to recover the condensable LCO components. The overhead vapor line 113, containing steam and uncondensable hydrocarbons, i.e., $C_5$-gasoline and some LCO, is tied into the flare line. The total MCB product approximately consists of the liquid feed to the tower, plus the liquid from the lowest fractionator tray in the tower. The system of FIG. 2 is disadvantageous, in that it requires numerous pieces of large equipment with high energy consumption, and moreover, as a result of the above considerations, valuable gasoline and some LCO components are generally required to be flared. In this system, as an alternative to flaring, an expensive recovery system may be used which employs, e.g., condensers, separators and pumps.

Figure 3:
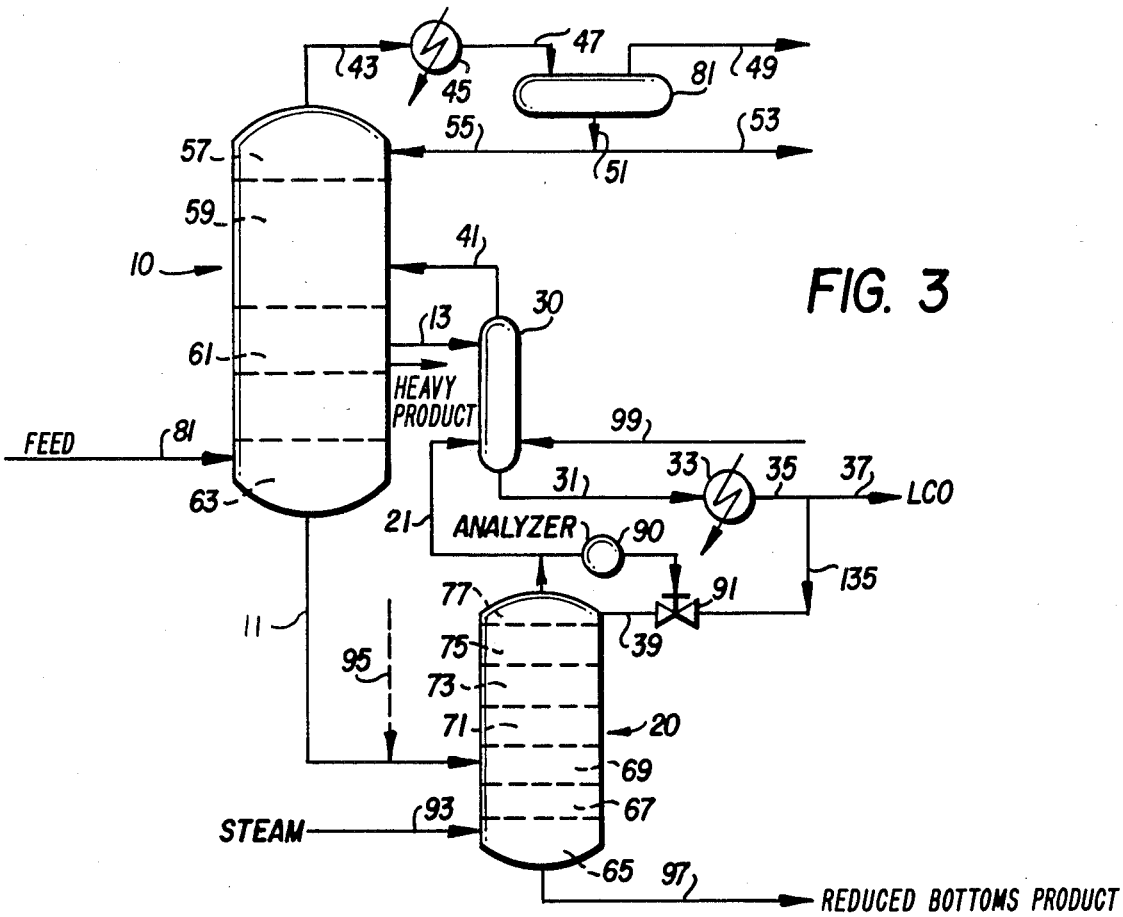
FIG. 3 illustrates a first embodiment of a system according to the present invention.
Figure 4:
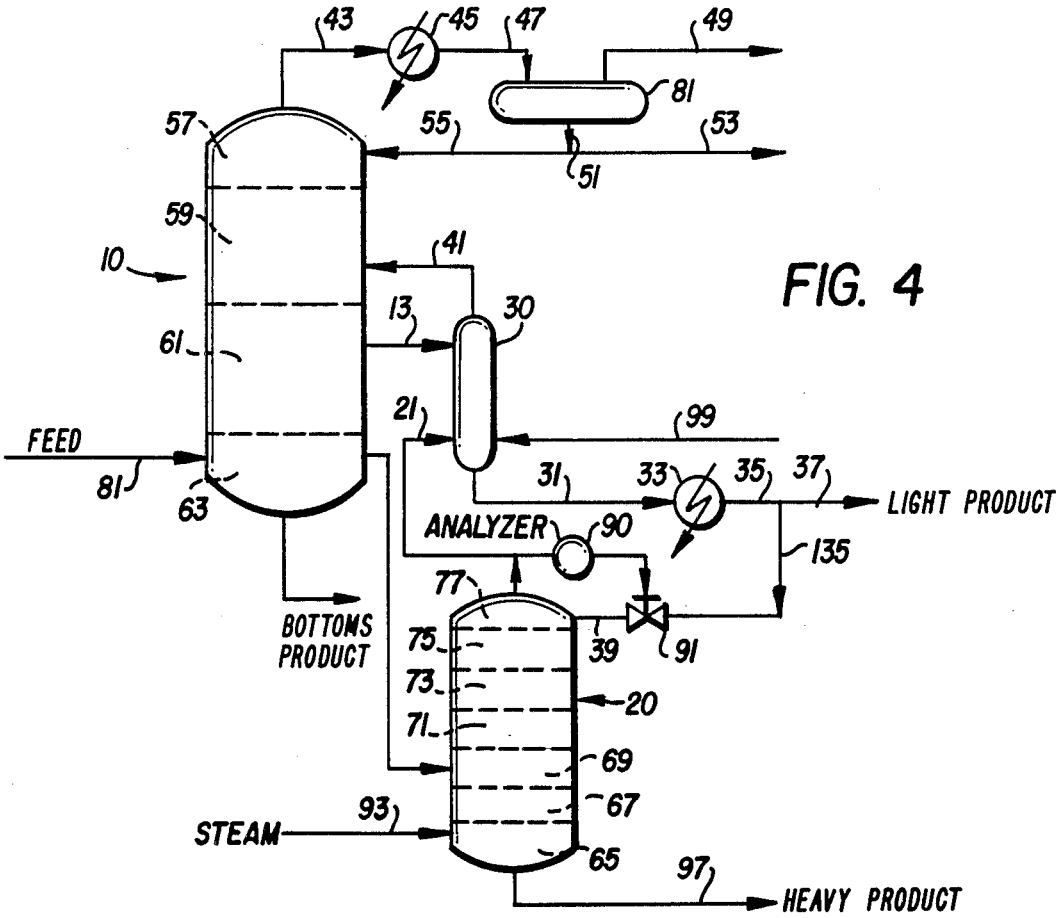
FIG. 4 illustrates a second embodiment of the present invention.

In FIG. 3, reference numeral 10 refers to a main column (MC) fractionator tower, in which reactor effluent is introduced along line 81. The reactor effluent is fractionated by MC fractionator 10, MCB/LCO fractionator 20 and LCO stripper 30 to recover desired end products. For example, in the case where MC tower 10 receives FCC effluent, the desired recovered products are light cycle oil, gasoline, liquid petroleum gas and fuel gas. MC fractionator tower 10 produces a heavy bottoms product fraction which is withdrawn through bottoms draw 11 and passed into MCB/LCO fractionator tower 20. A lighter fraction, e.g., a cycle oil, is withdrawn from section 61 of tower 10 through side draw 13 and passed to LCO stripper 30 for further fractionation, as described below in greater detail. FIG. 4 illustrates another embodiment, wherein a heavy product side draw 201 replaces bottoms product draw 11, in FIG. 3, to produce a heavy product which is passed to second fractionator 20. Line 37 carries a light product output from stripper 30.

Second fractionator tower 20 receives a stripping vapor, e.g., steam, in a lower section 65. This stripping vapor constitutes the only medium necessary for separating light components from MCB product in second fractionator tower 20. Tower 20 includes six stages, with the lower two stages serving as MCB stripping stages 67, 69 and the upper four stages serving as light end rectification stages 71, 73, 75 and 77.

Top tray 77 of second fractionation tower 20 receives LCO quench along line 39, which is taken along line 31 from the bottom of LCO stripper 30. In the embodiment illustrated in FIGS. 3 and 4, line 31 feeds into LCO cooler 33 which controls the temperature of the quench stream. Output 35 of cooler 33 is divided into two lines 37 and 135. Line 37 carries LCO product. The LCO provided by line 39 is provided to flow control valve means 91, which may be controlled by LCO end point analyzer 90 which provides a control signal to valve means 91. Condenser 33 and valve means 91 together control the ASTM End Point of the overhead vapor exiting second fractionating tower 20 via overhead line 21, by adjusting the flow rate and temperature of the LCO quench stream provided to top tray 75 of second fractonation tower 20. As seen from the above, the LCO quench comprises bottoms product from LCO stripper 30 and is provided at a predetermined low temperature and a predetermined variable flow rate. Vaporized LCO quench and recovered LCO pass via overhead line 21 into a lower section of LCO stripper 30. The vapor input to stripper 30, provided by line 21, provides the stripping medium for stripper 30. Because the MCB/LCO fractionator 20 overhead vapor primarily comprises steam, it can totally replace LCO stripping steam, which would be required by a conventional unit, such as that shown in FIG. 1. Also, condensation of quenched LCO and recovered LCO in LCO stripper 30 act as a heating source to improve fractionation between naptha and LCO in LCO stripper 30. LCO boiling range components are recovered in the bottoms product of LCO stripper 30 along line 37.

It should be noted that MCB/LCO fractionator tower 20 is operated at a sufficiently high pressure to provide integration of towers 10 and 20 and to allow transfer of overhead vapors to LCO stripper 30 and main column fractionation tower 10, thus enabling separation of recovered light ends into LCO, gasoline, LPG and fuel gas. It should also be noted that LCO stripper 30 and main column fractionator tower 10 fractionate the light ends recovered from MCB/LCO fractionator tower 20 without significantly affecting the equipment loadings and normal operations. It should be noted further that, as an alternative embodiment, LCO stripper 30 and MCB/LCO fractionator tower 20 can be combined into one single tower.

LCO stripper overhead line 41 carries lighter components from stripper 30 into main column fractionator tower 10. Thereafter, the lighter components pass via main column overhead line 43 to condenser 45, and then to gas/liquid separator 81 which provides gas exit line 49 and liquid exit line 53, both of which provide inputs to an FCC unsaturated gas plant (not shown), where these lighter components are further fractionated. Also, a portion of the product carried by liquid line 51 from separator 81 is diverted to a top section of main column fractionator 10, along line 55, to control the end point of the main column overhead. Overhead line 43 of main column fractionator tower 10 carries main column overhead vapor to condenser 45, which provides an output along line 47 to gas/liquid separator 81. Output 49 from separator 81 provides a gas exit line, while liquid line 51 is separated into liquid exit line 53, and line 55 which is passed into upper section 57 of main column fractionator tower 10.

The present invention includes introducing steam via line 93 into a bottom stripping section of LCO/MCB fractionator 20. Alternatively, steam via line 95 can be mixed with MCB coming from main column tower 10 along line 11. The steam mixes with MCB product, which results in flashing at the bottom of fractionator 20. Vapor which ascends through tower 20 is rectified by a cold stream of LCO quench entering top tray 75 of fractionator 20. A LCO quench stream provided via line 39 controls the recovered LCO ASTM End Point. This quench stream is preferably taken from the cooled LCO going to storage along line 37. The recovered LCO and gasoline components, plus the LCO quench, are carried by the steam injected via line 93 and/or 95 into tower 20, from the overhead of LCO/MCB fractionator 20 via line 21 to the bottom of LCO stripper 30. This arrangement eliminates the need for LCO stripping steam which would otherwise be introduced through line 99, which is required by prior art units (i.e., line 127 in FIGS. 1 and 2). These recovered hydrocarbons from the MCB product are then separated in LCO stripper 30 and main column system 10.

It should be noted that, according to the present invention, the operating pressure of LCO/MCB fractionator 20 falls within a moderate pressure range, e.g., approximately 40–50 psi, to make it possible to integrate fractionator 20 with main column fractionator tower 10. It has been found in computer simulations that the total light hydrocarbons recovery from MCB product is about 7%, which can be increased by using a steam stripping section at a bottom section of LCO/MCB fractionator 20, as discussed above. In such case, the total steam mixed with the MCB coming from main column tower 10 is preferably used as the stripping steam.

Figure 5:
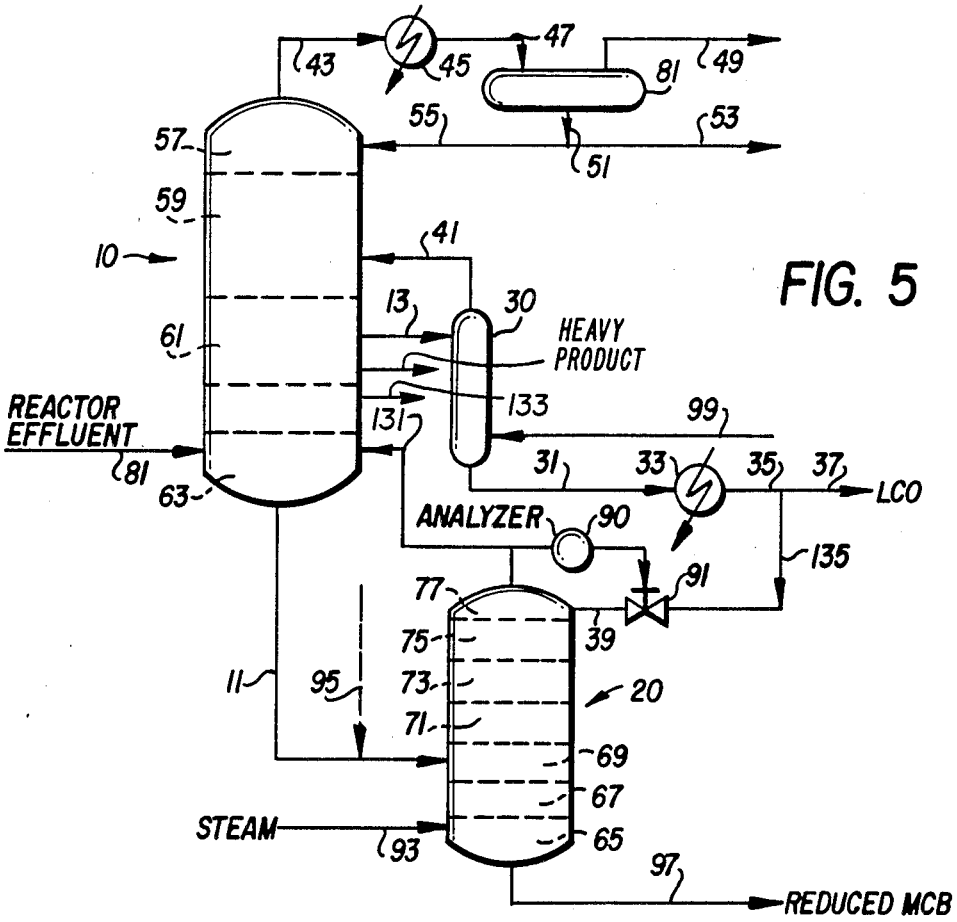
FIG. 5 illustrates a third embodiment of a system according to the present invention.
Figure 6:
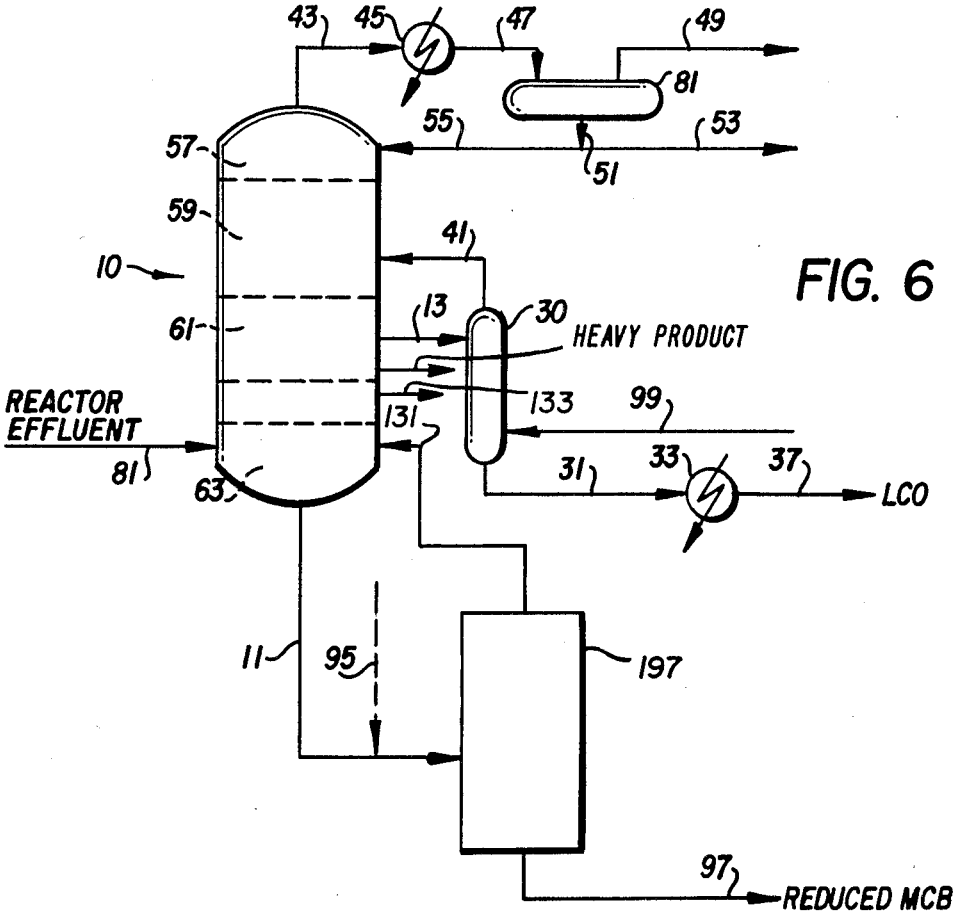
FIG. 6 illustrates a fourth embodiment of the present invention.

FIGS. 5 and 6 illustrate alternative embodiments, wherein LCO/MCB fractionator 20 (FIG. 5) or flash drum 197 (FIG. 6), have their overhead vapor taken to the main column system 10 via line 131 to a point above the MCB quench nozzle 133, for further fractionation of light components and MCB product. The arrangement of FIG. 6 results in an increase in the steam consumption and main column tray loadings, as compared with the FIGS. 3 and 4 embodiments. In this case, the liquid phase of the flash drum is the MCB product. Because the FIGS. 3 and 4 embodiments reuse the MCB stripping steam as LCO stripping steam and also reduce MC loadings, they are preferred over that of FIGS. 5 and 6.

The above-described embodiments of FIGS. 3–6 provide substantially improved results over those of the FIG. 2 system, which recovers LCO from MCB product using MCB flash-down in which the MCB is mixed with steam and flashed at low pressures, i.e., atmospheric or vacuum pressures. As noted above, the present invention provides for operating fractionator 20 or flash drum 197 at moderate pressures, which allows integration of the fractionator with main column 20. This reduces steam consumption, equipment sizing and the number of pieces of equipment required. Also, light product recovery and overhead liquid product recovery are improved significantly. By providing a system wherein fractionator 20 or flash drum 197 is integrated with main column 10 and stripper 30, the FIG. 2 liquid side draw 111 in fractionator 111 can be eliminated. Further, introduction of a light product quench stream from the rundown cooler-condenser 33 allows the FIG. 2 side pumparound in fractionator 20 to be eliminated. Also, replacement of stripper 30 stripping steam by fractionator 20 overhead vapor allows reduction of steam consumption. Additionally, the total light hydrocarbons recovery from the heavy product drawn from the main column can be increased by introduction of a stripping section to the bottom of fractionator 20, as discussed above. Furthermore, in the embodiment shown in FIGS. 5 and 6, the overhead of LCO/MCB fractionator 20 or flash drum 197 can be taken directly to the main column fractionator 10 for further fractionation.

Table 1 below represents data from a computer simulation of a conventional main column system, as in FIG. 1, and Table 2 includes data from a computer simulation of a system in accordance with the present claimed invention, with both tables being based on maximum gasoline operation at 55,000 barrels per stream day (BPSD) of FCC fresh feed rate. These simulations are based on the assumption that 99% ASTM distillation is equivalent to ASTM End Point. These tables provide material balance and operating conditions for the respective conventional FIG. 1 system and present inventive system. The simulations were performed for a main column flash zone temperature of 700° F. and MCB/LCO fractionator system of six stages (two stages for MCB stripping and four stages for rectifying the light ends). These tables indicate that MCB production is reduced, according to the present invention, by 370 BPD, i.e, 7.3%, assuming constant LCO ASTM 95% end point of 699° F. The increase in main column overhead vapor, overhead liquid and LCO are 10, 100 and 260 barrels per stream day (BPSD), respectively. The data given in Table 2 are based on taking the LCO quench from the outlet of LCO product cooler. If, as in the alternative embodiment described above, the LCO quench is taken directly from LCO stripper bottom, the quench rate must be increased by approximately 25%. The corresponding MCB product reduction for this configuration is approximately 330 BPSD.

Table 3 shows the results of another computer simulation (with a different set of operating parameters from those of Tables 1 and 2), based on a comparison of the FIG. 2 system and the FIG. 3 system, without stripping section 65, 67. Table 3 illustrates that the total main column bottoms product in a moderate pressure flashdown main column bottoms/light cycle oil fractionator operating at about 40 psi is approximately the same as the low pressure flashdown system illustrated in FIG. 2. This is because, in order to control the LCO end point, the additional material that is lifted by the steam at the bottom of the low pressure flashdown tower, shown in FIG. 2, falls back down with the liquid stream from the lowest tray in the tower. Additionally, Table 3 illustrates that in the moderate pressure flashdown system of the present invention, the recoverable hydrocarbons from main column bottoms is about 44% higher than the known low pressure flashdown system. This is considered to result from tying the overhead vapor line from the moderate pressure flashdown tower 20 into the light cycle oil stripper 30. This overhead vapor line contains all the recoverable hydrocarbon components and, further, the flashdown light cycle oil draw is no longer required. In addition, in the light cycle oil stripper 30, the light cycle oil components from the main column LCO fractionator tower 20, condense into the main column 10 light cycle oil product recovered along line 37, while the lighter components are recovered in the main column unsaturated gas plant system (not shown). In the above examples, approximately 8000 lbs/hr light cycle oil stripping steam, which result in sour water production, is saved, because the overhead line 21 from MCB/LCO fractionator tower 20 can completely replace the light cycle oil stripping steam, which would otherwise be provided to stripper 30 via line 99. The temperature of the overhead products from MCB/LCO fractionator tower 20, e.g., approximately 500° F., is higher than the temperature of stripping steam, which otherwise would be provided to light cycle oil stripper 30, and the MCB/LCO fractionator 20 overhead products contain condensable hydrocarbons. As a result, the light cycle oil stripper 30 will run hotter than in the known system, shown in FIG. 2, thus providing enhanced separation of the main column gasoline and light cycle oil.

Also, as seen from the results of Table 3, another significant advantage of the system according to the present invention is that the flashdown pumparound duty is 3.7 MMBTU/hr in the FIG. 2 system, whereas the quench duty in the FIG. 3 embodiment (without a stripper section 65, 67) is 1.6 MMBTU/hr. In the low pressure main column bottoms flashdown system shown in FIG. 2, a packed bed 129 is provided in tower 105 to provide heat transfer at low pressure drops. In the system according to the present invention, because the total heat removal from tower 20 is small and pressure drop considerations are not as important, packed bed 129 of the FIG. 2 system can be replaced merely by another tray. Furthermore, in the system of the present invention, a cold light product stream is provided as a quench to the top tray of flashdown tower 20. This quench stream can be taken from the bottoms product of light product stripper 30 or, alternatively, can be obtained from the main column 10 light cycle oil product exchanger. This enables the chimney tray, the light cycle oil P/A pump and the P/A heat exchanger in FIG. 2 to be eliminated. Table 3 indicates that the quench stream can be small, e.g., approximately 200 BPSD for a 55,000 BPSD FCC unit, and the quench stream is completely recoverable in stripper 30. This quench stream also provides the advantage of decreasing the required heat removal in flashdown tower 20, because the overhead molecular weight is increased, which requires the overhead temperature to increase also. Finally, the required diameter of flashdown tower 20 is smaller than in the known FIG. 2 system, i.e., approximately 3 ft as compared to 4 ft.

Primary advantages of a moderate pressure main column bottoms flashdown system, according to various embodiments of the present invention, particularly as compared with the low pressure system illustrated in FIG. 2 and the conventional FIG. 1 system, are shown in Tables 1–3 and are summarized as follows. A substantial increase in hydrocarbon recovery from the main column bottoms product and substantial savings on light cycle oil stripping steam are both provided. A 25% reduction in required second tower diameter can be obtained, and the packed bed in the known flashdown tower can be replaced with a less expensive and more efficient tray. Further, a heat exchanger, a pump and a chimney tray can be eliminated. Finally, the main column light cycle oil and gasoline fractionation efficiency is increased.

TABLE 1

Figure 1:
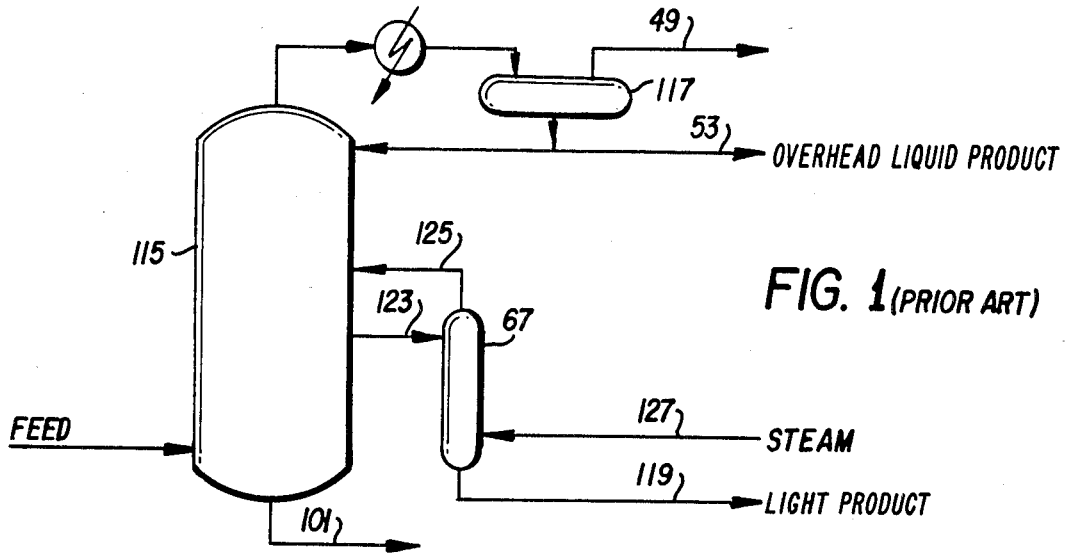
FIG. 1 (PRIOR ART)
FIG. 1 illustrates a conventional main column fractionation system with a single side stripper.

Material Balance and Operating Conditions for FIG. 1 Conventional Main Column System

| Stream (Line Nos. Shown in FIG. 1) | 49 | 53 | 119 | 121 | 123 | 125 | 127 |
|---|---|---|---|---|---|---|---|
| BPD | 19830 | 27750 | 12570 | 5060 | 14040 | 2020 | 540 |
| Temperature, °F. | 100 | 100 | 377 | 690 | 396 | 388 | 380 |
| Pressure, psia | 30.7 | 30.7 | 38.8 | 40.6 | 38.0 | 38.4 | 45.0 |
| Moles/Hr | | | | | | | |
| $C_5$− | 3273.6 | 814.6 | 0.3 | 3.5 | 22.8 | 22.4 | |
| 110–430 | 283.0 | 2233.3 | 112.7 | 7.9 | 206.9 | 94.1 | |
| 430–720 | | 65.6 | 700.3 | 58.8 | 726.0 | 25.8 | |
| 720+ | | | 13.3 | 205.0 | 13.3 | | |
| $H_2O$ | 115.6 | | 12.7 | 0.5 | 1.7 | 429.0 | 440.0 |
| Total | 3672.2 | 3113.5 | 839.3 | 275.7 | 970.7 | 571.3 | 440.0 |

TABLE 2

Material Balance and Operating Conditions for the FIG. 3 System

| Stream (Line Numbers Shown in FIG. 2) | 49 | 53 | 37 | 11 | 13 | 41 | 99 | 93 | 39 | 21 | 97 |
|---|---|---|---|---|---|---|---|---|---|---|---|
| BPD | 19830 | 27850 | 12870 | 5060 | 14090 | 2170 | 0 | 540 | 600 | 1510 | 4690 |
| Temperature, °F. | 100 | 100 | 404 | 690 | 396 | 393 | | 380 | 100 | 517 | 619 |
| Pressure, psia | 30.7 | 30.7 | 38.8 | 40.6 | 38.0 | 38.4 | | 45.0 | 42.0 | 41.0 | 43.8 |
| Moles/Hr | | | | | | | | | | | |
| $C_5$− | 3275.3 | 816.2 | 0.6 | 3.5 | 22.9 | 25.8 | | | | 3.6 | |
| 110–430 | 283.1 | 2241.4 | 112.5 | 7.9 | 207.4 | 94.7 | | | 5.2 | 13.1 | |
| 430–720 | | 66.0 | 716.1 | 58.7 | 728.6 | 36.7 | | | 33.5 | 49.6 | 42.6 |
| 720+ | | | 13.9 | 205.0 | 13.4 | | | | 0.6 | 1.1 | 204.5 |
| $H_2O$ | 115.5 | | 12.1 | 0.5 | 1.7 | 425.0 | | 440.0 | 0.6 | 436.0 | 5.0 |
| Total | 3673.9 | 3123.6 | 855.2 | 275.6 | 974.0 | 582.2 | 0 | 440.0 | 39.9 | 503.4 | 252.1 |

TABLE 3

| | FIG. 2 Low Pressure Flash Down | Modified FIG. 3 Moderate Pressure System |
|---|---|---|
| Flash Down Tower Top Pressure, psia | 18 | 40 |
| MCB Liquid into the MCB/LCO Fractionator, BPSD | 2611 | 2877 |

TABLE 3-continued

| | FIG. 2 Low Pressure Flash Down | Modified FIG. 3 Moderate Pressure System |
|---|---|---|
| MCB Liquid From Tray 1, BPSD | 632 | 368 |
| Total MCB Product*, BPSD | 3243 | 3245 |
| Reduction in MCB Product Rate, BPSD | 239 | 237 |
| Recoverable Hydrocarbons From MCB, BPSD | 165 | 237 |

*Hydrocarbons Feed to the Flash Down Tower = 3482 PBSD

The above description and the accompanying drawings are merely illustrative of the application of the principles of the present invention and are not limiting. Numerous other arrangements which embody the principles of the invention and which fall within its spirit and scope may be readily devised by those skilled in the art. Accordingly, the invention is not limited by the foregoing description, but is only limited by the scope of the appended claims.

I claim:

1. A fractionation method, comprising passing a feedstream to be fractionated to a first fractionator and (a) withdrawing a first relatively heavy product and a second relatively light product from said first fractionator;

(b) introducing said second relatively light product into a light product stripping zone;

(c) introducing said first relatively heavy product into a stripping zone of a second fractionator for stripping relatively lighter components from said first relatively heavy product, said second fractionator operating in a predetermined moderate pressure range sufficient to provide integration of said second fractionator with said first fractionator and said light product stripping zone; and (d) introducing a quench stream comprising relatively light stripped product from said light product stripping zone into a rectifying zone of said second fractionator to control an end point of said overhead product exiting said second fractionator.

2. The method as in claim 1, wherein said overhead product exiting said second fractionator is introduced into said light product stripping zone.

3. The method as in claim 1, wherein said overhead product exiting said second fractionator is introduced into said first fractionator.

4. The method as in claim 1, wherein said first relatively heavy product is withdrawn from a bottom draw of said first fractionator.

5. The method as in claim 1, wherein said first relatively heavy product is withdrawn from a side draw of said first fractionator.

6. A fractionation method, comprising passing a feedstream to be fractionated to a first fractionator and (a) withdrawing bottoms product from said first fractionator and introducing said withdrawn bottoms product into a second fractionator operating in a predetermined moderate pressure range sufficient to provide integration of said second fractionator with said first fractionator and to allow transfer of overhead product from said second fractionator into a stripper zone and thereafter into said first fractionator;

(b) separating said withdrawn bottoms product into relatively light ends and relatively heavy ends by introducing stripping vapor into said second fractionator;

(c) introducing a controlled stream of light product quench comprising bottoms product from said stripper zone at a predetermined low temperature and variable flow rate into said second fractionator to adjust an end point of overhead products exiting said second fractionator;

(d) passing said overhead products exiting said second fractionator into said stripper and introducing relatively lighter product components from said first fractionator into said stripper zone, said overhead products from said second fractionator stripping light ends from said relatively lighter product components; and (e) separating overhead product from said stripper zone into relatively light ends and relatively heavy ends by introducing overhead product from said stripper zone into said first fractionator, such that said stripper overhead product is further fractionated in said first fractionator.

7. The method as in claim 6, wherein said first fractionator is a main column fractionator of a fluid catalytic conversion system.

8. The method as in claim 7, wherein said stripping zone comprises a light cycle oil stripper.

9. The method as in claim 8, wherein said second fractionator comprises a main column bottoms/light cycle oil fractionator.

10. The method as in claim 9, wherein said stripping vapor and said bottoms product from said main column fractionator are mixed prior to being introduced into said main column bottoms/light cycle oil fractionator.

11. The method as in claim 10, wherein said controlled stream of light cycle oil quench is passed through cooling means prior to being introduced into said main column bottoms/light cycle oil fractionator.

12. The method as in claim 9, wherein said stripping vapor comprises steam.

13. The method as in claim 9, wherein said overhead product from said main column bottoms/light cycle oil fractionator introduced into said light cycle oil stripper comprises stripping vapor for said cycle oil introduced into said light cycle oil stripper.

14. The method as in claim 9, wherein said light cycle oil stripper and said main column fractionator fractionate light ends overhead product introduced from said main column bottoms/light cycle oil fractionator into said light cycle oil stripper.

15. The method as in claim 9, wherein said controlled stream of light cycle oil quench is introduced into a top tray in said main column bottoms/light cycle oil fractionator to control an ASTM End Point of light ends separated from said main column bottoms product introduced into said main column bottoms/light cycle oil fractionator.

16. The method as in claim 15, wherein said light cycle oil quench is taken directly from said light cycle oil stripper bottoms.

17. The method as in claim 15, further comprising cooling said light cycle oil stripper bottoms product and taking said light cycle oil quench from said cooled light cycle oil stripper bottoms product.

18. The method as in claim 9, wherein said main column bottoms/light cycle oil fractionator operates in a pressure range of approximately 40–50 psi.

19. The method as in claim 9, wherein step (b) comprises a flash separation process.

20. The method as in claim 9, further comprising introducing overhead product from said first fractionator into a gas-liquid separator and recovering unstabilized gasoline from said separator.

21. A fractionation apparatus, comprising:

(a) a first fractionator having a first relatively heavy product draw and a second relatively light product draw;

(b) a light product stripper receiving relatively light product from said second relatively light product draw; and (c) a second fractionator operating in a predetermined moderate pressure range sufficient to provide integration of said second fractionator with said first fractionator and said light product stripping zone, said second fractionator receiving said relatively heavy product draw and having a stripping zone for stripping lighter components from relatively heavier components introduced therein from said first relatively heavy product draw and a rectifying zone receiving a quench stream comprising relatively light stripped product from said light product stripper to control an end point of an overhead vapor stream exiting said second fractionator.

22. The apparatus as in claim 21, wherein the overhead vapor stream exiting the second fractionator is introduced into said light product stripper.

23. The apparatus as in claim 21, wherein the overhead vapor stream exiting said second fractionator is introduced into said first fractionator.

24. The apparatus as in claim 21, wherein said relatively heavy product draw is a bottoms product draw.

25. The apparatus as in claim 21, wherein said relatively heavy product draw is a side product draw.

26. A fractionation apparatus, comprising:

(a) a first fractionator including a bottoms outlet at a bottom section thereof for removal of bottoms product, an intermediate inlet at an intermediate section thereof and a light product outlet below said intermediate inlet;

(b) a stripper including a bottoms outlet, an inlet at a lower section thereof, an inlet at an upper section thereof connected to said light product outlet of said first fractionator, and an overhead outlet connected to said intermediate inlet of said first fractionator;

(c) a second fractionator operating in a predetermined moderate pressure range sufficient to provide integration of said second fractionator with said first fractionator and to allow transfer of overhead product from said second fractionator into said stripper and thereafter into said first fractionator, said second fractionator having a bottoms product inlet connected to said bottoms outlet of said first fractionator, means for admitting stripping vapor into said second fractionator below said bottoms product inlet and an overhead products outlet connected to said inlet at said lower section of said stripper; and (d) means for introducing a controlled stream of bottoms product from said bottoms outlet of said stripper into said second fractionator, said stream having a predetermined low temperature and variable flow rate to control an end point of overhead products exiting said overhead products outlet of said second fractionator, whereby bottoms product from said first fractionator flashes in said second fractionator from contact with stripping vapor introduced therein, light ends from said second fractionator pass into said stripper to strip light ends introduced into said stripper from said first fractionator and light ends from said stripper pass into said first fractionator for further fractionation.

27. The apparatus as in claim 26, wherein said first fractionator comprises a main column fractionator of a fluid catalytic conversion system.

28. The apparatus as in claim 27, wherein said stripper comprises a light cycle oil stripper.

29. The apparatus as in claim 28, wherein said second fractionator comprises a main column bottoms/light cycle oil fractionator.

30. The apparatus as in claim 29, further comprising means for mixing said stripping vapor with said bottoms product and subsequently introducing said mixture into said main column bottoms/light cycle oil fractionator.

31. The apparatus as in claim 30, further comprising a condenser interconnecting said bottoms outlet of said light cycle oil stripper and said main column bottoms/-light cycle oil fractionator.

32. The apparatus as in claim 29, wherein said stripping vapor comprises steam.

33. The apparatus as in claim 29, wherein said overhead product from said main column bottoms/light cycle oil fractionator introduced into said lower section of said light cycle oil stripper comprises stripping vapor for said cycle oil introduced into said upper section of said light cycle oil stripper.

34. The apparatus as in claim 29, wherein said light cycle oil stripper and said main column fractionator fractionate light ends overhead product introduced from said main column bottoms/light cycle oil fractionator into said lower section of said light cycle oil stripper.

35. The apparatus as in claim 29, wherein said controlled stream of light cycle oil quench is introduced into a top tray in said main column bottoms/light cycle oil fractionator to control an ASTM End Point of light ends separated from said main column bottoms product introduced into said main column bottoms/light cycle oil fractionator.

36. The apparatus as in claim 35, wherein said light cycle oil quench is taken directly from said light cycle oil stripper.

37. The apparatus as in claim 35, further comprising means for cooling said light cycle oil stripper bottoms product and wherein said light cycle oil quench comprises light cycle oil stripper bottoms product.

38. The apparatus as in claim 29, wherein said main column bottoms/light cycle oil fractionator operates in a pressure range of approximately 40–50 psi.

39. The apparatus as in claim 29, further comprising a gas-liquid separator receiving overhead product from said first fractionator and means for recovering unstabilized gasoline from said separator.

40. A method of recovering overhead liquid and light product from bottoms product in a fractionation system which includes a first fractionator, stripper means, and a second fractionator, comprising the steps of:

operating said second fractionator in a predetermined moderate pressure range sufficient to provide integration of said second fractionator with said first fractionator and to allow transfer of overhead product from said second fractionator into said stripper and thereafter into said first fractionator;

introducing a controlled stream of bottoms product from a bottoms outlet of said stripper means into said second fractionator, said stream having a predetermined low temperature and flow rate to control and end point of overhead product exiting an overhead product outlet of said second fractionator;

flash separating bottoms product from said first fractionator in said second fractionator from contact with stripping vapor introduced therein;

passing light ends from said second fractionator into said stripper means to strip relatively light ends introduced into said stripper means from said first fractionator and to recover relatively heavy ends from said stripper means; and passing light ends from said stripper means into said first fractionator for further fractionation.

* * * * *